US010738629B2

(12) United States Patent
Granberg et al.

(10) Patent No.: US 10,738,629 B2
(45) Date of Patent: Aug. 11, 2020

(54) GAS TURBINE GUIDE VANE SEGMENT AND METHOD OF MANUFACTURING

(71) Applicant: Siemens Aktiengesellschaft, Munich (DE)

(72) Inventors: Per Granberg, Norsholm (SE); Janos Szijarto, Finspong (SE)

(73) Assignee: Siemens Aktiengesellschaft, Munich (DE)

( * ) Notice: Subject to any disclaimer, the term of this patent is extended or adjusted under 35 U.S.C. 154(b) by 129 days.

(21) Appl. No.: 15/744,112

(22) PCT Filed: Jul. 19, 2016

(86) PCT No.: PCT/EP2016/067109
§ 371 (c)(1),
(2) Date: Jan. 12, 2018

(87) PCT Pub. No.: WO2017/045809
PCT Pub. Date: Mar. 23, 2017

(65) Prior Publication Data

US 2018/0195400 A1 Jul. 12, 2018

(30) Foreign Application Priority Data

Sep. 14, 2015 (EP) ..... 15185103

(51) Int. Cl.
*F01D 5/18* (2006.01)
*F01D 9/04* (2006.01)
*F01D 11/02* (2006.01)

(52) U.S. Cl.
CPC ..... *F01D 9/041* (2013.01); *F01D 5/186* (2013.01); *F01D 11/02* (2013.01);
(Continued)

(58) Field of Classification Search
CPC ..... F01D 9/065; F01D 9/041; F01D 25/005; F01D 25/12; F01D 25/125;
(Continued)

(56) References Cited

U.S. PATENT DOCUMENTS 3,286,461 A * 11/1966 Johnson ..... F01D 5/081 60/787
3,965,066 A * 6/1976 Sterman ..... F01D 9/023 60/800

(Continued)

FOREIGN PATENT DOCUMENTS

CN 103228870 10/2013
EP 1731715 A1 12/2006

(Continued)

OTHER PUBLICATIONS

EP Search Report dated Mar. 10, 2016, for EP patent application No. 15185103.7.

(Continued)

*Primary Examiner* — Woody A Lee, Jr.
*Assistant Examiner* — Brian Christopher Delrue
(74) *Attorney, Agent, or Firm* — Beusse Wolter Sanks & Maire

(57) ABSTRACT

A gas turbine guide vane segment has a first guide vane part with an aerofoil and a first platform section and a second guide vane part with a second platform section. The first guide vane part and the second guide vane part are separately manufactured parts joined together such that the second platform section defines a leading edge of the gas turbine guide vane segment and such that the first platform section and the second platform section form an aligned common platform surface of the gas turbine guide vane segment. The first platform section includes slots in the first platform section for guiding cooling fluid along a surface of (Continued)

the first platform section for film cooling of the surface, the slots being provided at an upstream bend of the first platform section and the slots are provided on a side of the first platform section facing the working fluid.

13 Claims, 3 Drawing Sheets

(52) U.S. Cl.
CPC .. *F05D 2230/211* (2013.01); *F05D 2230/237* (2013.01); *F05D 2240/121* (2013.01); *F05D 2240/81* (2013.01)

(58) Field of Classification Search
CPC ..... F05D 2240/12; F05D 2240/15; F05D 2260/20; F05D 2260/232; F05D 2260/98; F05D 2300/6033; Y02T 50/672; Y02T 50/676
See application file for complete search history.

(56) References Cited

U.S. PATENT DOCUMENTS 4,292,008 A * 9/1981 Grosjean ..... F01D 5/186 415/115
4,375,891 A * 3/1983 Pask ..... F01D 11/025 277/384
4,642,024 A * 2/1987 Weidner ..... F01D 11/08 415/116
4,821,522 A * 4/1989 Matthews ..... F01D 9/023 415/175
5,344,283 A * 9/1994 Magowan ..... F01D 5/187 415/115
5,398,496 A * 3/1995 Taylor ..... F01D 9/023 60/752
5,470,198 A * 11/1995 Harrogate ..... F01D 9/023 415/115
6,196,791 B1 * 3/2001 Tomita ..... F01D 5/081 415/115
6,854,738 B2 * 2/2005 Matsuda ..... F01D 9/023 277/632
6,988,369 B2 * 1/2006 Conete ..... F23R 3/007 60/796
7,004,720 B2 * 2/2006 Synnott ..... F01D 9/041 415/115
7,114,339 B2 * 10/2006 Alvanos ..... F01D 5/081 60/806
7,189,055 B2 * 3/2007 Marini ..... F01D 5/081 415/115
7,360,988 B2 * 4/2008 Lee ..... F01D 9/00 29/889.22
7,452,184 B2 * 11/2008 Durocher ..... F01D 5/081 415/115
7,527,469 B2 * 5/2009 Zborovsky ..... F01D 9/041 277/412
7,695,247 B1 * 4/2010 Liang ..... F01D 5/186 416/193 A
7,726,131 B2 * 6/2010 Sze ..... F23R 3/002 60/754
7,836,702 B2 * 11/2010 Grivas ..... F01D 9/023 415/139
7,857,580 B1 * 12/2010 Liang ..... F01D 9/06 415/115
7,976,274 B2 * 7/2011 Lee ..... F01D 5/143 415/190
8,231,354 B2 * 7/2012 Campbell ..... B23P 15/04 416/193 A
8,388,307 B2 * 3/2013 Smoke ..... F01D 9/02 415/134
8,783,044 B2 * 7/2014 Steiger ..... F01D 5/186 415/115
8,950,192 B2 * 2/2015 Tschuor ..... F01D 9/023 60/800
9,115,593 B2 * 8/2015 Suciu ..... F02C 7/047
9,175,568 B2 * 11/2015 Ryan ..... B22F 3/1055
9,200,536 B2 * 12/2015 McCaffrey ..... F01D 25/162
9,752,447 B2 * 9/2017 Clum ..... F01D 9/023
9,828,914 B2 * 11/2017 Suciu ..... F02C 7/06
2005/0254942 A1 * 11/2005 Morrison ..... F01D 5/282 415/200
2009/0196737 A1 * 8/2009 Mitchell ..... F01D 5/186 415/115
2009/0280011 A1 * 11/2009 Tibbott ..... F01D 5/081 416/95
2011/0311389 A1 * 12/2011 Ryan ..... B22F 3/1055 419/27
2012/0060503 A1 3/2012 Schnieder et al.
2013/0205793 A1 * 8/2013 Xu ..... F23R 3/06 60/754
2013/0205794 A1 * 8/2013 Xu ..... F01D 5/186 60/754
2013/0272849 A1 10/2013 Khanin et al.
2016/0245093 A1 * 8/2016 Deibel ..... F01D 9/041

FOREIGN PATENT DOCUMENTS

EP 2428647 A1 3/2012
FR 3003599 A1 9/2014
WO 2014165518 A1 10/2014

OTHER PUBLICATIONS

International Search Report dated Sep. 23, 2016, for PCT/EP2016/067109.

* cited by examiner

GAS TURBINE GUIDE VANE SEGMENT AND METHOD OF MANUFACTURING

CROSS REFERENCE TO RELATED APPLICATIONS

This application is the US National Stage of International Application No. PCT/EP2016/067109 filed Jul. 19, 2016, and claims the benefit thereof. The International Application claims the benefit of European Application No. EP15185103 filed Sep. 14, 2015. All of the applications are incorporated by reference herein in their entirety.

FIELD OF THE INVENTION

The invention relates to a gas turbine guide vane segment built from two separate parts and consecutively joined.

BACKGROUND OF THE INVENTION

Gas turbine engines mainly comprise a compressor section, a combustor section, and a turbine section. The turbine section itself again is comprised of a plurality of turbine stages. Each turbine stage consists of a set of guide vanes followed by a set of rotor blades. The guide vanes and the rotor blade experience high temperatures during operation and therefore are manufactured from high temperature resistant material and/or require cooling features to withstand the high temperatures. A complete ring of guide vanes typically consists of a plurality of guide vane segments. Such a segment typically comprises at least a platform and at least one airfoil.

Such guide vane segments are typically cast elements that are manufactured by known manufacturing techniques. Casting is a manufacturing process in which moulds are filled with liquid materials that are subsequently solidified. In such a casting process there is a limitation in geometry and in providing cooling features, as not all possible configurations can be produced.

Casting of guide vane segments can be very expensive if a lot of material is needed to build the guide vane segment. To reduce the costs typically that material is selected that is perfectly adapted for the to be expected temperatures.

One casting technique which is typically more expensive than "normal" casting is the so called precision casting.

From EP 1 731 715 A1 it is known that a gap may be present between a downstream end of a combustor and consecutive turbine section. This gap may be closed via a cover as a further separate component. According to a figure in this document the cover may follow the form of a segment of a cylinder.

EP 2 428 647 A1 also focuses on a transition area between a combustor and a turbine section. A heat shield will be placed as a boundary surface for the flow path.

FR 3 003 599 A1 relates to a vane with an annular platform, the vane being characterized in that an inner ring comprises a first annular plate attached to a radial wall, said plate including an end annular strip folded to bear against a radial annular wall. The strip is adjacent to the back surface of the annular platform.

Referring back to the cooling features of guide vane segments, besides providing cooling cavities and cooling holes in the guide vane segment, it could be an alternative to provide cooling features from an adjacent component like the exit of the compressor or to provide additional stator or rotor components that allow cooling air to impinge onto a surface of the guide vane segment.

SUMMARY OF THE INVENTION

The present invention seeks to mitigate drawbacks that have been explained before.

This objective is achieved by the independent claims. The dependent claims describe advantageous developments and modifications of the invention.

In accordance with the invention there is provided a gas turbine guide vane segment, comprising a first guide vane part and a second guide vane part. The first guide vane part comprises an aerofoil and a first platform section, the first platform section being a segment of a boundary wall for a working fluid flow during operation. The second guide vane part comprises a second platform section and a seal section, the second platform section being a segment of the boundary wall for a working fluid flow during operation and the seal section being an element of a seal arrangement at an, in respect of a flow direction of the working fluid, upstream end of the gas turbine guide vane segment. The first guide vane part and the second guide vane part are separately manufactured parts joined together such that the second platform section defines a leading edge of the gas turbine guide vane and such that the first platform section and the second platform section form an aligned—particularly uniform—common platform surface of the gas turbine guide vane segment. Further, the first platform section comprises slots in the first platform section for guiding cooling fluid along a surface of the first platform section for film cooling of the surface, the slots being provided at an upstream bend of the first platform section and the slots are provided on a side of the first platform section facing the working fluid.

Therefore the first guide vane part and the second guide vane part are distinct components that can individually be manufactured by different manufacturing processes or even by the same manufacturing process. For example these two parts or only one of these parts can be manufactured by casting, even more advantageously by precision casting. The same material or different materials could be used for these two parts. In an advantageous solution, the second guide vane part is built from precision casting, the first guide vane part by non-precision casting.

The joining of the two parts could advantageously be performed by brazing the second guide vane part on the first guide vane part. Alternative bonding techniques can be used to join these two parts. In one embodiment the joining will be performed in a way that the parts will be inseparable. In another embodiment it may be advantageous that the two parts are still separable after joining.

Such a gas turbine guide vane segment built from two separate parts may be advantageous as different material and different production methods can be used which individually can be optimised in the most beneficial way. Furthermore by having two separate parts elements can be generated that cannot be built by a single cast element. This solution is particularly advantageous if already an existing casting exists for the aerofoil and most of the parts of the guide vane so that an existing mould can be used for the casting and only a smaller second guide vane part may individually be manufactured. To join two separate parts may also be advantageous if the guide vane segment is still in the process of testing so that different types of second guide vane parts can be used for the test while always the identical first guide vane part is used. Furthermore, some specific cooling features can be added to the gas turbine guide vane segment which typically would be difficult to be generated by casting.

The gas turbine guide vane segment is particularly produced to be located in a turbine section of a gas turbine engine.

Even more advantageously the gas turbine guide vane segment will be used for a first turbine guide vane stage following a combustor. In such a configuration a stationary part of the combustor may be followed by a further stationary part by the turbine but without having a fixed connection between the two parts to accommodate temperature variations. Therefore a gap may be present between the combustor section and the turbine section which should be as small as possible to reduce the inflow of hot working fluid into the gap during operation. The danger of ingress of hot fluid is a substantial reason why the second guide vane part comprises a seal section. The seal section may be an upstream seal in front of the turbine vane segment.

The term "upstream" is meant in the direction of the fluid flow of a working fluid or working media during operation of the gas turbine. "Downstream" would be the opposite direction. The upstream direction also will be called the (positive) axial direction of the gas turbine. Additionally, the radial direction is the direction which is perpendicular to the rotational axis of the gas turbine and which will be the direction of the expanse of the aerofoil. Furthermore the term "circumferential direction" may be used in this application which is the direction perpendicular both to the radial direction at a specific location and to the axial direction.

As explained before the first and the second platform sections define the boundary wall for a working fluid flow during operation of the gas turbine engine. Several gas turbine guide vane segments will be assembled together to form an annular ring defining an annular passage for the working fluid. Therefore by looking only at a single gas turbine guide vane segment you may see the platform as being particularly flat but in general they follow a cylindrical shape when assembled together by several segments. According to the invention, a first platform section and a second platform section will be shaped and designed in a way that they, when assembled together, form a common platform section. The first platform section will be downstream of the second platform section. The first guide vane part and the second guide vane part are assembled in such a way that particularly a surface of the first platform section and the surface of the second platform section are aligned such that a common, substantially plain surface or smooth surface is built. The surfaces form a homogeneous or even or uniform common overall surface. Particularly the first and second platform sections are arranged such that no or only minor turbulences will be generated by the region where the first and the second platform sections will converge. The surface of the first platform section has the same orientation as the surface of the second platform section.

"Aligned common platform surface" specifically means that an aligned uniform common platform surface is built from the two adjacent surfaces of the first and second platform sections. The overall common surface is a smooth gas-washed surface. The two surfaces meet each other free of a bend and also free of a step (besides some minor misalignments, which may be acceptable).

The surface of the first platform section and the surface of the second platform section form a common surface shape adapted to a fluid flow along the first platform section and the second platform section.

The surface of the first platform section and the surface of the second platform section are levelled.

In the region where the first guide vane part and the second guide vane part will connect, cooling holes are present for film cooling of the remainder of a surface of the first guide vane part and particularly for film cooling of the first platform section. As already stated, the first platform section therefore comprises slots in the first platform section for guiding cooling fluid along a surface of the first platform for film cooling of the surface, the slots being provided at an upstream bend or step of the first platform and the slots are provided on a side of the first platform facing the working fluid. The mentioned bend defines an upstream end of the first platform section. The slots may be distributed along the length of the bend, but advantageously without having slots directly in front of the aerofoil. The mentioned slots only form one half of passages which are defined by the mentioned slots and by corresponding elements that are located on a surface of the second guide vane part. At the second guide vane part the second platform section may comprise grooves in the second platform section for guiding cooling fluid directed at the bend or onto the bend of the first platform. The grooves may be provided at the downstream end of the second platform section and the grooves may be provided on a surface of the second platform section facing away from the working fluid. The slots and the grooves may be aligned in pairs to each other when the first guide vane part and the second guide vane part are assembled. Therefore, during operation, cooling fluid may be guided first into the grooves and then into the slots to allow the mentioned film cooling. The grooves may particularly be distributed along a downstream rim of the second platform section advantageously under omission of a central region of the rim so that again the aerofoil will not be provided with film cooling air.

The grooves may particularly be shaped as to have a continuous increasing depth in downstream direction. Correspondingly the slots may have a continuous reducing depth in downstream direction.

As it can be seen from the above explanation, a groove and a slot are advantageously aligned to another and form a common cooling fluid passage, particularly a film cooling hole.

A second guide vane part, as explained before, comprises—or forms—a platform component and a seal component. These two components are connected by a wall lateral to the second platform. The wall may be connected to the second platform section. This connection may be in a mid-range of the second platform section. Therefore you could define the second platform section having a front-section and an aft-section in relation to the wall. The front-section extends in upstream direction of the wall and is present to reduce an opening or gap between the front-section and a further upstream component, for example the end of a combustion section. Depending on the heat transfer within the front-section the below surface of the front-section may comprise turbulators for improved cooling. "Below" in this respect means the direction away from the working fluid path and defines a back face of the front-section.

The wall may provide a plurality of cooling fluid holes that are angled onto the back face of the front-section. If the wall is brazed onto an opposite wall of the first guide vane part, advantageously additional cooling holes are also present in the first guide vane part. These additional cooling holes may be aligned to the previously mentioned cooling fluid holes through the wall to cool the back face of the front-section.

Besides the front-section, the second guide vane part may comprise a flange which is directed substantially parallel to the second platform section or the front-section. The flange may be a component of the mentioned seal section and forms a barrier for the working fluid during operation so that no or limited hot working fluid will ingress into a cavity in front of the claimed gas turbine guide vane segment.

The seal may be a non-contact seal by using flanges that overlap each other, but without physically touching another.

The invention is also directed to a method of manufacturing a gas turbine guide vane segment, comprising the following steps: (i) generating, particularly by casting, a monolithic first guide vane part comprising an aerofoil and a first platform section, the first platform section being a segment of a boundary wall for a working fluid flow during operation; (ii) generating, particularly by precision casting or additive manufacturing, a monolithic second guide vane part comprising a second platform section and the seal section, the second platform section being a segment of the boundary wall for a working fluid flow during operation and the seal section being an element of a seal arrangement at an, in respect of a flow direction of the working fluid, upstream end of the gas turbine guide vane segment; (iii) joining, particularly by brazing, the first guide vane part and the second guide vane part, such that the second platform section defines a leading edge of the gas turbine guide vane and such that the first platform section and the second platform section form an aligned common platform surface of the gas turbine guide vane segment.

Particularly both, the first guide vane part and the second guide vane part are built from a material with a coefficient of expansion due to heat which is the same or very similar to another. Advantageously even the same material is used for both parts.

As an optional method step the joint first and second guide vane part may both be coated by a coating procedure to allow thermal resistance. In such a coating process in an intermediate step, the cooling holes may be masked. The coating may be performed prior or after the joining of the first and second guide vane part.

As a further optional method step slots and/or grooves as explained before may be prepared by casting or may be manufactured or machined into the solid platforms to provide cooling holes or cooling passages for film cooling of the guide vane platform.

Precision casting may alternatively also be called investment casting and provides a very precise product that does not need a lot of extra steps in finishing the component. Precision casting allows the production of very fine components and details, providing a smooth surface finish of the produced components. Precision casting itself is a known technique but can be applied to both single guide vane parts that were introduced for the gas turbine guide vane segment.

As a further example such a gas turbine guide vane segment may even be comprised of more than two guide vane parts which all could be produced via casting and then could be joined together.

It has to be noted that embodiments of the invention have been described with reference to different subject matters. In particular, some embodiments have been described with reference to apparatus type claims whereas other embodiments have been described with reference to method type claims. However, a person skilled in the art will gather from the above and the following description that, unless other notified, in addition to any combination of features belonging to one type of subject matter also any combination between features relating to different subject matters, in particular between features of the apparatus type claims and features of the method type claims is considered as to be disclosed with this application.

Furthermore examples have been and will be disclosed in the following sections by reference to gas turbine engines. The invention is also applicable for any type of turbomachinery, e.g. compressors or steam turbines. Furthermore the general concept can be applied even more generally to any type of machine. It can be applied to rotating parts as well as stationary parts.

The aspects defined above and further aspects of the present invention are apparent from the examples of embodiment to be described hereinafter and are explained with reference to the examples of embodiment.

BRIEF DESCRIPTION OF THE DRAWINGS

Embodiments of the invention will now be described, by way of example only, with reference to the accompanying drawings, of which.

The illustration in the drawing is schematic. It is noted that for similar or identical elements in different figures, the same reference signs will be used.

Some of the features and especially the advantages will be explained for an assembled gas turbine, but obviously the features can be applied also to the single components of the gas turbine but may show the advantages only once assembled and during operation. But when explained by means of a gas turbine during operation none of the details should be limited to a gas turbine while in operation.

DETAILED DESCRIPTION OF THE INVENTION

Figure 1:
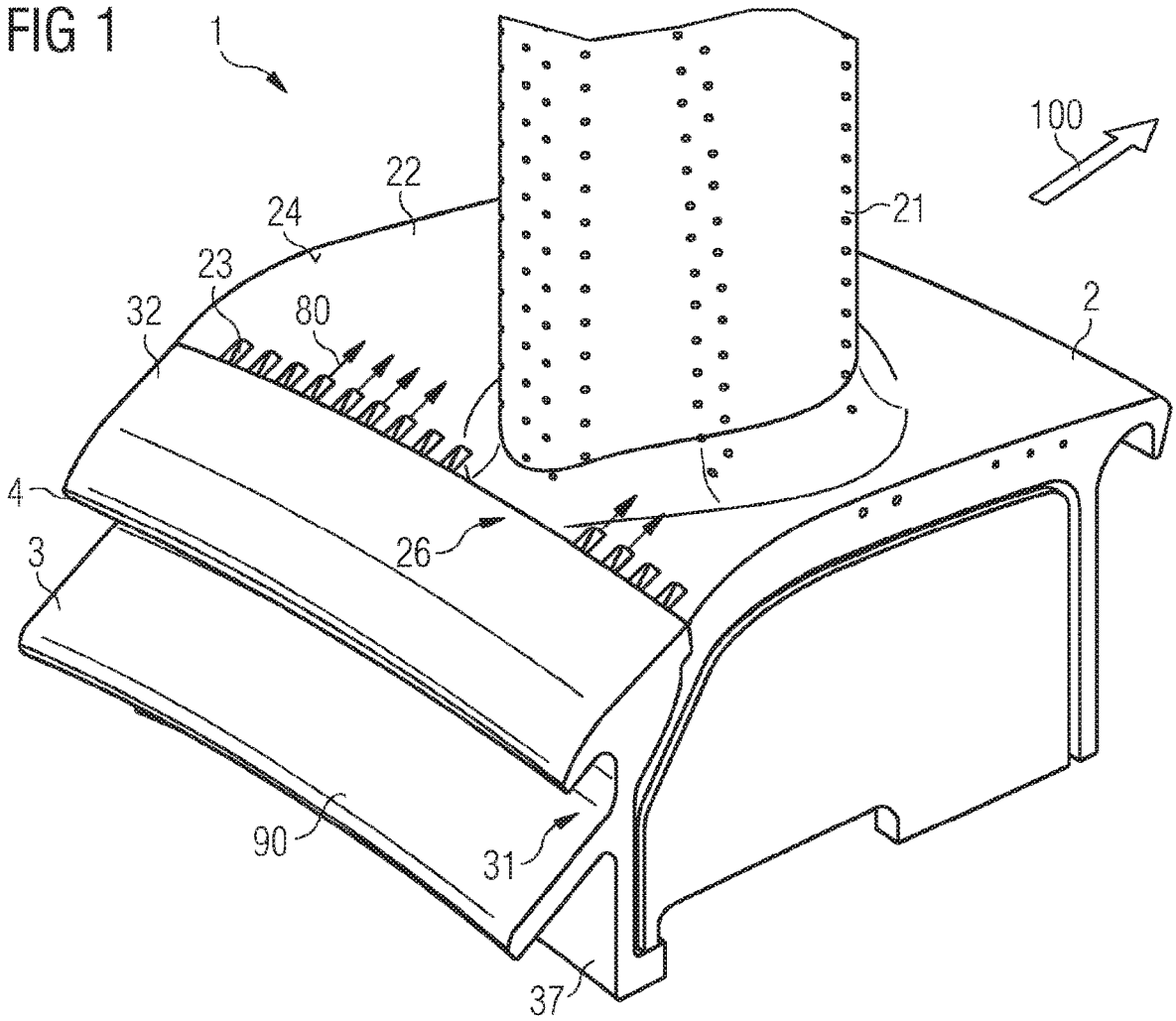
FIG. 1: shows schematically a gas turbine guide vane segment according to the invention in a perspective view.

FIG. 1 shows a gas turbine gas vane segment 1 consisting of two separately manufactured parts. These parts are the first guide vane part 2 and the second guide vane part 3. A plurality of these gas turbine guide vane segments 1 generate a full ring for a turbine stage within a gas turbine engine. The first guide vane part 2 comprises an aerofoil 21 and a first platform section 22. The aerofoil 21 will extend into a working fluid path of the turbine section of the gas turbine engine. The first platform section 22 is a segment of a boundary wall for that working fluid flow during operation, i.e. a working fluid washed surface. The working fluid is the output of an upstream combustor and is typically a hot gas.

The second guide vane part 3 shows a geometry of an upstream end of the gas turbine guide vane segment 1. Particularly the second guide vane part 3 comprises a second platform section 32 and a seal section 31. The second platform section 32, like the first platform section 22, is also a segment of the boundary wall for the working fluid flow during operation. The seal section 31 is an element or a subcomponent of a seal arrangement 50 at an, in respect of a flow direction of the working fluid, upstream end of a gas turbine guide vane segment 1. The seal arrangement 50 is particularly a seal that blocks ingress of hot working fluid into a cavity which is outside of the main working fluid path. The cavity is upstream of the guide vane segment and downstream of a further component which is located upstream of the guide vane segment. Therefore the seal arrangement is provided to disallow hot working fluid attacking components which are distant to the hot working fluid path that are not prepared to withstand the hot temperatures.

According to FIG. 1 the first guide vane part 2 and the second guide vane part 3 are shown as being attached or joined to another. Nevertheless the first guide vane part 2 and the second guide vane part 3 are separately manufactured parts that are joined in a further consecutive method step together. When joined the first guide vane part 2 and the second guide vane part 3 are aligned to another such that the second platform section 32 defines a leading edge 4 of the gas turbine vane segment 1 and such that the first platform section 22 and the second platform section 32 form an aligned homogeneous or even or uniform common platform surface 42 of the gas turbine guide vane segment 1. By an aligned common platform surface 42 it is meant to have a geometry that corresponds between the two adjacent platform sections 32 and 22. Thus, assuming the second platform section 32 is angled in a specific way an upstream portion of the first platform section 22 is angled in the same way. So the flow of the working fluid will not be disrupted by joining the two components. The joined first guide vane part 2 and second guide vane part 3 form a smooth overall surface.

The direction of the flow of a working fluid 100 is indicated in FIG. 1 by an arrow.

At an upstream end of the first platform section 22 a plurality of slots 23 are indicated through which cooling fluid 80 can pass through such that cooling fluid 80 build a film cooling layer on top of the first platform section 22, particularly above or along the surface 24. The slots 23 are distributed along the circumferential length of the first platform section 22 but particularly in FIG. 1 there is a central region 26 defined in which no slots are present. This central region is particularly in front of the aerofoil 21 as the aerofoil 21 would anyhow disrupt a film cooling effect. The flow of the cooling fluid 80 is indicated by small arrows in the FIG. 1.

The front or upstream section of the gas turbine guide vane segment 1 is defined by the second guide vane part 3. The second guide vane part 3 is built from three subcomponents: The already mentioned second platform section 32, a connecting wall 37 substantially perpendicular or at least lateral to the second platform section 32, and a flange 90. An upstream end of the second platform section 32 and the flange 90 are a part of the seal section 31. The seal section 31 of the second guide vane part 3 act as a seal arrangement 50 together with other components as shown later on in FIG. 3.

The second guide vane part 3 may particularly be manufactured by precision casting. Later on it may be joined advantageously by brazing to the first guide vane part 2. After the joining step the first guide vane part 2 and the second guide vane part 3 form a common gas turbine guide vane segment 1. In the end, after attaching the two guide vane parts 2 and 3, the gas turbine guide vane segment 1 will be handled as one single component, which then can be assembled to a full guide vane ring. The full guide vane ring then defines an annular working fluid flow passage of a gas turbine engine.

Figure 2:
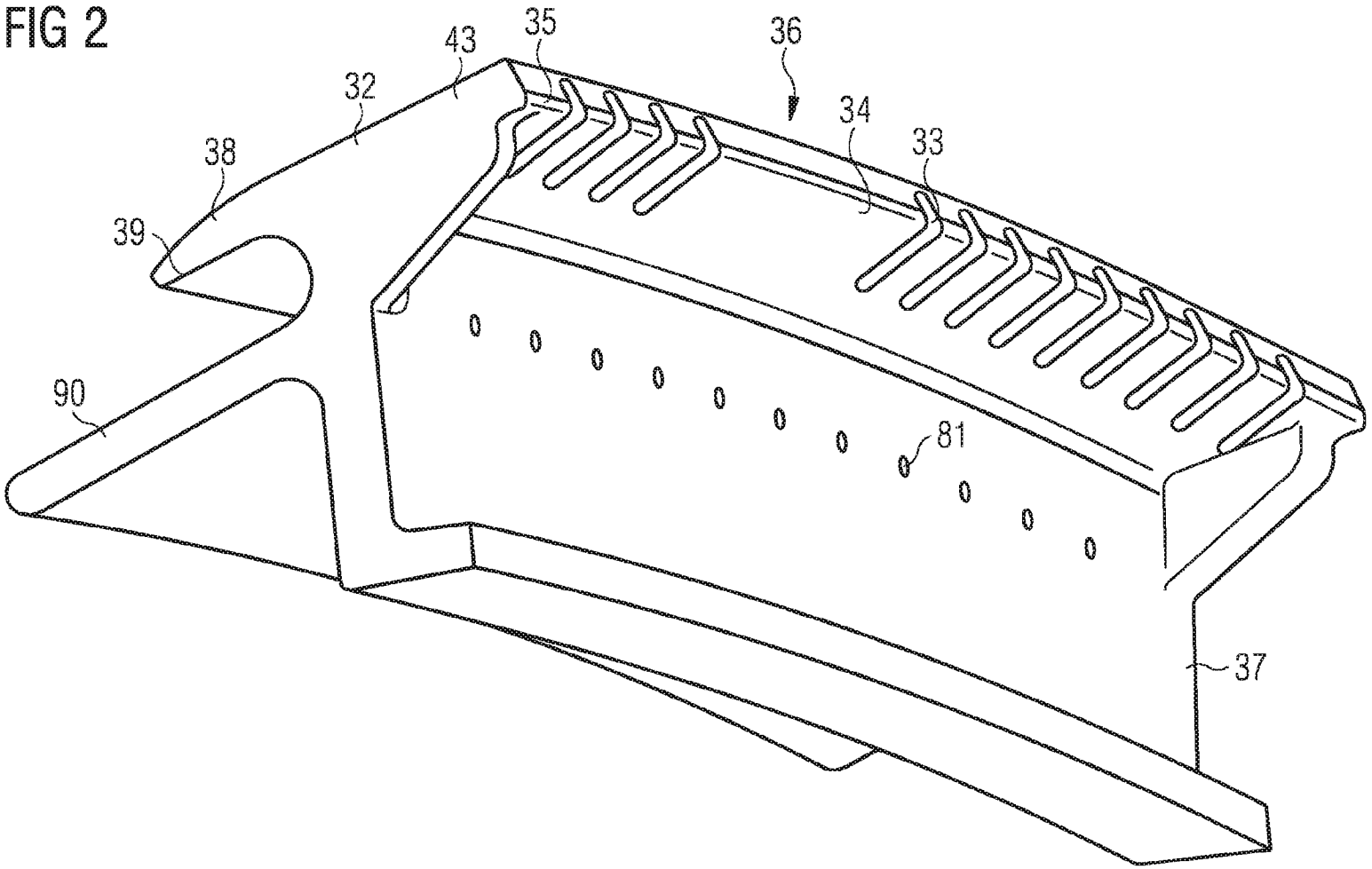
FIG. 2: illustrates in a perspective view one component of the gas turbine guide vane segment.

Proceeding now to FIG. 2 the second guide vane part 3 is depicted now in a more detailed way in a three dimensional view. Again the second platform section 32 is shown and the connecting wall 37 together with the flange 90. The flange 90 and the second platform section 32 are arranged particularly in parallel to each other. Both of these components are substantially perpendicular to the connecting wall 37. The connecting wall 37 connects to the second platform section 32 in a mid region of that second platform 32 so that the front-section 38 and an aft-section 43 is present in either direction of the connecting wall 37. At the aft-section 43 grooves 33 are present in a surface 34 that is directed away from the hot working fluid path. Therefore the surface 34 is a back surface of the second platform section 32 (which again is a working fluid washed surface). The grooves 33 are present to direct cooling fluid onto a front region of the first platform section 22 as indicated also by FIG. 1. An end of the second platform section 32 is defined by a downstream rim 35 and is slotted by the grooves 33. Again as before, the central region 36 does not show any grooves 33 because this central region is aligned with the aerofoil 21 of the first guide vane part 2 in which no film cooling is needed (this can be seen by referring also to FIG. 1).

As seen in FIG. 2 additionally a plurality of cooling fluid holes 81 are present and pierce the connecting wall 37. The cooling holes 81 are passages through the connecting wall 37 and impinge onto a back face 39 of the front-section 38 of the second platform section 32. With the term "back face 39" again a surface is meant that is directed away from the working fluid path. The cooling fluid holes 81 therefore are directed into a cavity that can be identified between the front-section 38 of the second platform section 32, the flange 90, and a section of the connecting wall 37. Furthermore, the second guide van part 3 shows some lids and rims which allow easier attachment of the second guide vane part 3 to the first guide vane part 2 and that can be used for joining these two separate parts.

Figure 3:
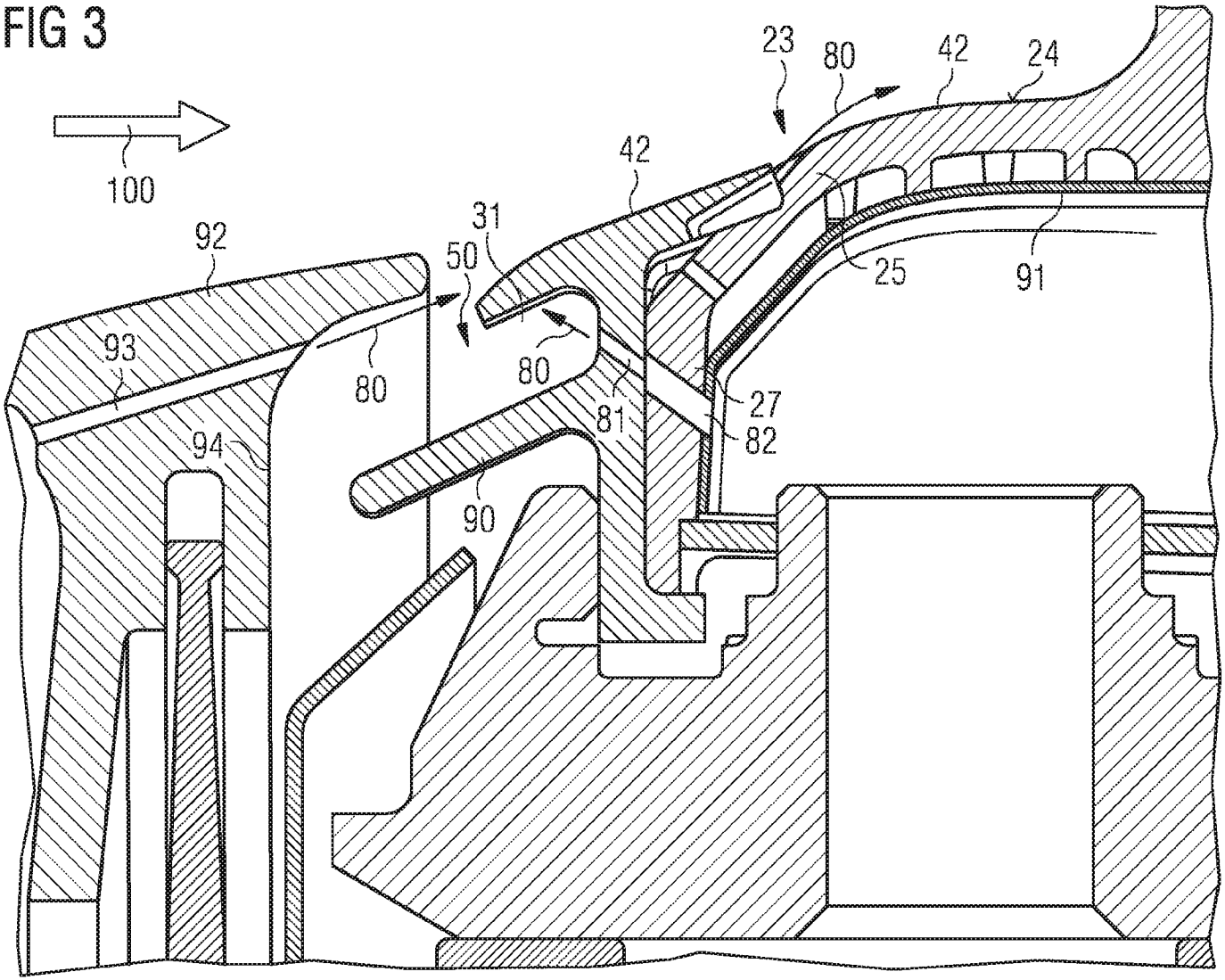
FIG. 3: illustrates in a cross-sectional view how different component of the gas turbine guide vane segment and a combustor are aligned to another.

Turning now to FIG. 3 a part of the gas turbine guide vane segment 1 is shown in a cross sectional view together with an upstream combustor segment wall 92. Alternatively this component identified by reference numeral 92 could also be a transition duct between a combustor section and a turbine section or could even a rotary component like a trailing platform region of a rotor blade.

The working fluid 100 is indicated in its flow direction again by an arrow. The combustor section wall 92 comprises a circumferential rim and similar to the second platform section 32 and the first platform section 22 it defines a gas washed surface that is a boundary wall of the working fluid flow. The combustor segment wall 92 is a stationary component similar to the also stationary gas turbine guide vane segment 1. Nevertheless there may be a gap between the combustor and the gas turbine guide vane segment 1 so that these two components can accommodate material extension due to increased temperatures. Therefore a space is provided between the downstream end of the combustor and the upstream end of the turbine section. And this gap is needed to be sealed, which is provided by the already mentioned seal arrangement 50. The seal arrangement 50 is defined by an end wall 94 of the combustor and the seal section 31 of the second guide vane part 3.

Cooling fluid 80 is, as already mentioned in relation to FIG. 2, provided via the cooling fluid holes 81 into a void or cavity of the seal arrangement 50. As you can see in FIG. 3 further cooling fluid passages 82 are present in the first guide vane part 2 so that cooling air can be provided via the cooling fluid passages 82 to the cooling fluid holes 81. Therefore the cooling fluid passages 82 and the cooling fluid holes 81 are aligned to another and angled correspondingly. The cooling fluid passages 82 in the first guide vane part 2 are specifically manufactured or generated in the front wall 27 of the first guide vane part 2. The front wall 27 is an internal wall which is particularly present so that the second guide vane part 3 can be attached to the first guide vane part 2. The cross sectional view in FIG. 3 is specifically cut in a region where the cooling fluid holes 81 and the cooling fluid passages 82 are present and additionally the slots 23 and grooves 33 can be seen. As you can see in the Figure the grooves 33 of the second guide vane part 3 and the slots 23 of the first guide vane part 2 are aligned to another so that cooling fluid 80 can pass through the groove 33 and the corresponding slot 23 and then will be injected into the working fluid as a film cooling for the surface 24.

It also can be seen in FIG. 3 that the second platform section 32 and the first platform section 22 form a common platform surface 42 which is a steady and homogenous common surface. To provide such a uniform surface the first guide vane part 2 has an upstream bend 25 in which the first platform section 22 has a tilted configuration and merges into the front wall 27. Cooling fluid 80 may be provided to the grooves 33 through an impingement plate 91 and possibly through other cooling channels (not shown) through walls of the first guide vane part 2.

The combustor segment wall 92 may additionally have also cooling channels 93 present that may be wanted to provide an extra cooling effect on an upstream end of the second guide vane part 3 or to improve the sealing effect of the seal arrangement 50. The cooling channels 93 may be directed to the leading edge 4 of the second platform section 32.

A gas turbine guide vane segment 1 built from two separate and distinct pieces—first guide vane part 2 and second guide vane part 3—may have several advantages. One advantage is that different material and different manufacturing methods can be used. Furthermore more specific cooling arrangements can be produced which may not be possible in standard manufacturing processes of a single component. Furthermore the second guide vane part 3 can easily be exchanged and configured so that for example for prototype testing different types of second guide vane parts 3 can be equipped on a standard first guide vane part 2. Additionally as cooling holes and cooling passages are aligned and are present in the second guide vane part 3 and the first guide vane part 2 there is a possibility to adjust a cooling fluid through these holes by simply changing the width and the pattern of cooling holes in one of the guide vane parts 2 or 3.

It is important for the configuration in this detailed description that two distinct and separate parts are generated and assembled afterwards, that means the first guide vane part 2 and separately the second guide vane part 3. It is also important to mention that these parts itself are only built as a single piece and shall not be considered to be again a combination of separate sub parts. So the first guide vane part 2 is specifically a monolithic piece built from one material and built by one manufacturing process like casting. The same is true for the second guide vane part 3 which also shall be a single monolithic part which is generated by one production method, for example by precision casting or even by additive manufacturing. Joining of these two distinct parts may particularly be provided by brazing but also other ways of joining components can be used.

The invention claimed is:

1. A gas turbine guide vane segment, comprising:

a first guide vane part comprising an aerofoil and a first platform section, the first platform section being a segment of a boundary wall for a working fluid during operation, and a second guide vane part comprising a second platform section and a seal section, the second platform section being a segment of the boundary wall for a working fluid during operation and the seal section being an element of a seal arrangement at an, in respect of a flow direction of the working fluid, upstream end of the gas turbine guide vane segment, wherein the first guide vane part and the second guide vane part are separately manufactured parts joined together such that the second platform section defines a leading edge of the gas turbine guide vane segment and such that the first platform section and the second platform section form an aligned common platform surface of the gas turbine guide vane segment, wherein the first platform section comprises slots in a surface facing the working fluid of the first platform section for guiding cooling fluid along the surface facing the working fluid of the first platform section for film cooling of the surface facing the working fluid, the slots located at an upstream bend of the first platform section, and wherein the second platform section comprises grooves in the second platform section for guiding a film cooling fluid directly onto the surface facing the working fluid, the grooves located at a down-stream end of the second platform section and the grooves located on a surface of the second platform section facing away from the working fluid.

2. The gas turbine guide vane segment according to claim 1, wherein the slots are distributed along the upstream bend.

3. The gas turbine guide vane segment according to claim 1, wherein the slots have a continuous reducing depth in downstream direction.

4. The gas turbine guide vane segment according to claim 3, wherein the grooves have a continuous increasing depth in downstream direction.

5. The gas turbine guide vane segment according to claim 3, wherein the grooves and the slots are aligned in pairs to allow cooling fluid from the grooves into the slots during operation.

6. The gas turbine guide vane segment according to claim 1, wherein the grooves are distributed along a downstream rim of the second platform section.

7. The gas turbine guide vane segment according to claim 1, wherein the second guide vane part comprises a connecting wall lateral to the second platform section which is connected to the second platform section, wherein the second platform section comprises a front-section, wherein the connecting wall provides a plurality of cooling fluid holes, the plurality of cooling fluid holes being angled onto a back face of the front-section.

8. The gas turbine guide vane segment according to claim 7, wherein the plurality of cooling fluid holes through the connecting wall are each aligned with cooling fluid passages in a front wall of the first guide vane part.

9. The gas turbine guide vane segment according to claim 1, wherein the second guide vane part comprises a flange substantially parallel to the second platform section, the flange being a component of the seal section as a barrier for the working fluid during operation.

10. The gas turbine guide vane segment according to claim 1, wherein the seal section forms a non-contact seal with a further element of the seal arrangement.

11. The gas turbine guide vane segment according to claim 1, wherein the first guide vane part and the second guide vane part are joined together such that the first guide vane part and the second guide vane part are joined inseparably.

12. The gas turbine guide vane segment according to claim 1, wherein the grooves abut the slots so that the cooling fluid exits the grooves and directly enters the slots.

13. A gas turbine guide vane segment, comprising:

a first guide vane part comprising an aerofoil and a first platform section, the first platform section being a segment of a boundary wall for a working fluid during operation, and a second guide vane part comprising a second platform section and a seal section, the second platform section being a segment of the boundary wall for a working fluid during operation and the seal section being an element of a seal arrangement at an, in respect of a flow direction of the working fluid, upstream end of the gas turbine guide vane segment, wherein the first guide vane part and the second guide vane part are separately manufactured parts joined together such that the second platform section defines a leading edge of the gas turbine guide vane segment and such that the first platform section and the second platform section form an aligned common platform surface of the gas turbine guide vane segment, wherein the first guide vane part and the second guide vane part are joined inseparably via brazing, wherein the first platform section comprises slots in a surface facing the working fluid of the first platform section for guiding cooling fluid along the surface facing the working fluid of the first platform section for film cooling of the surface facing the working fluid, the slots located at an upstream bend of the first platform section, and wherein the second platform section comprises grooves in the second platform section for guiding a film cooling fluid directly onto the surface facing the working fluid, the grooves located at a down-stream end of the second platform section and the grooves located on a surface of the second platform section facing away from the working fluid.

* * * * *